US007036471B2

(12) United States Patent
Minami et al.

(10) Patent No.: US 7,036,471 B2
(45) Date of Patent: May 2, 2006

(54) INTAKE AIR CONTROL APPARATUS AND METHOD FOR INTERNAL COMBUSTION ENGINE

(75) Inventors: Yutaro Minami, Yokohama (JP); Hiroshi Iwano, Yokohama (JP); Hikaru Ooba, Yokohama (JP); Naonori Onoda, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/206,106

(22) Filed: Aug. 18, 2005

(65) Prior Publication Data

US 2006/0037569 A1 Feb. 23, 2006

(30) Foreign Application Priority Data

Aug. 23, 2004 (JP) ..... 2004-242066

(51) Int. Cl.
*F01L 1/34* (2006.01)

(52) U.S. Cl. ..... 123/90.15; 123/90.17; 123/399

(58) Field of Classification Search ..... 123/90.15, 123/90.16, 90.17, 90.18, 90.27, 90.31, 345, 123/346, 347, 348, 391, 399, 403; 701/110; 73/117.3, 118.2

See application file for complete search history.

(56) References Cited

U.S. PATENT DOCUMENTS 6,397,800 B1 * 6/2002 Nohara et al. ..... 123/90.15
6,647,935 B1 * 11/2003 Aoyama et al. ..... 123/90.16
6,877,466 B1 4/2005 Shindou et al.

FOREIGN PATENT DOCUMENTS

JP 2001-263105 A 9/2001

* cited by examiner

*Primary Examiner*—Thomas Denion
*Assistant Examiner*—Ching Chang
(74) *Attorney, Agent, or Firm*—Foley & Lardner LLP

(57) ABSTRACT

In intake air control apparatus and method for an internal combustion engine, a target angle calculating section calculates a target angle of one of first and second variably operated valve mechanisms from a target load in accordance with an accelerator opening angle and a present engine speed, a variably operated valve mechanism actual angle outputting section derives and outputs an actual angle of the one of the first and second variably operated valve mechanisms which is varied toward the target angle, and another target angle calculating section calculates another target angle of the other of the first and second variably operated valve mechanisms from a derived and outputted present corresponding variably operated valve mechanism actual angle equivalent value, the present engine speed, and the target load on the basis of a known relationship among four of the working angle, the central angle, the engine speed, and a load.

18 Claims, 11 Drawing Sheets

FIG.5
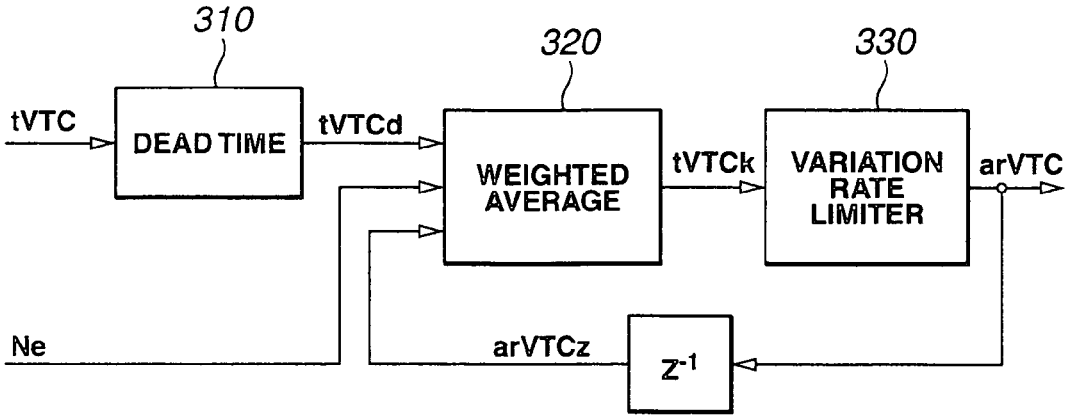
FIG.6A
FIG.6B
FIG.6C
FIG.6D
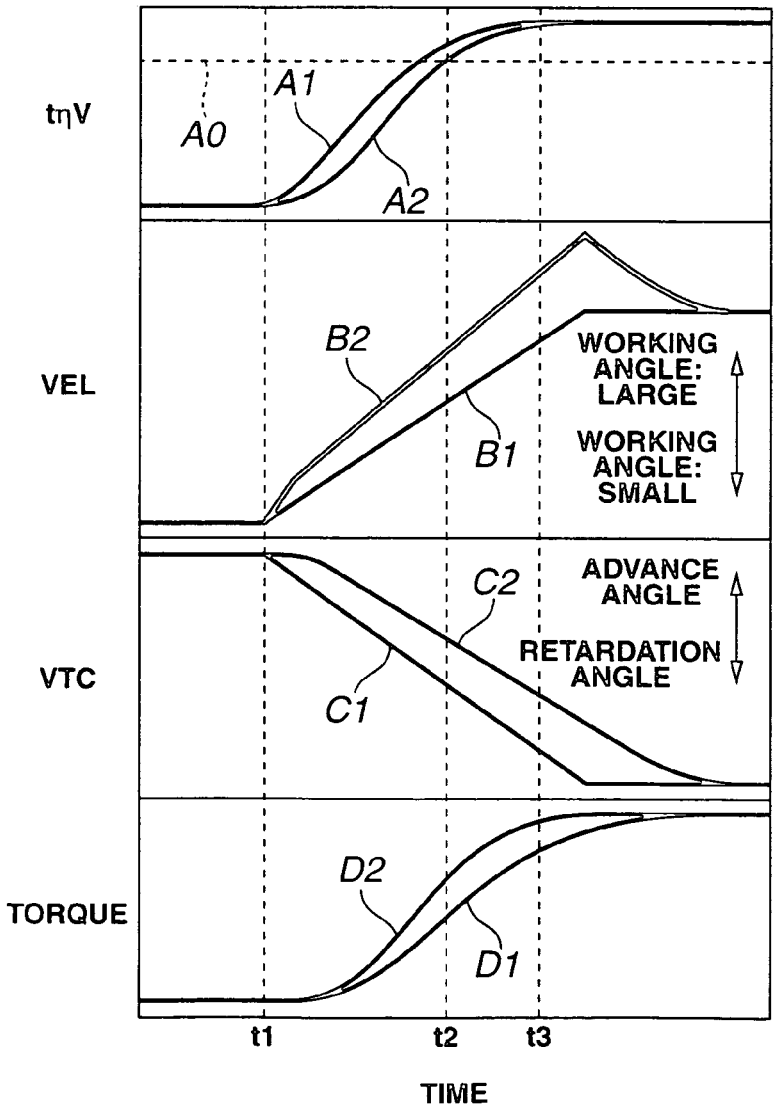

tηV
A0
A1
A2

VEL
B2
B1
WORKING ANGLE: LARGE
WORKING ANGLE: SMALL

VTC
C22
C12
C11
C21
ADVANCE ANGLE
RETARDATION ANGLE

TORQUE
D2
D12
D11
t1
t2
t3
TIME

INTAKE AIR CONTROL APPARATUS AND METHOD FOR INTERNAL COMBUSTION ENGINE

BACKGROUND OF THE INVENTION

1. Field of the Invention

The present invention relates to intake air control apparatus and method for an internal combustion engine in which an intake air quantity sucked into a cylinder of the engine and, more particularly, relates to the intake air control apparatus and method for the internal combustion engine in which an intake air quantity control is achieved by means of a variable control of a valve lift characteristic of an intake valve (or intake valves).

2. Description of the Related Art

An intake air quantity is controlled by means of an opening angle control of a throttle valve, generally, installed within an intake air passage. As is well known in the art, in such a kind of control method, a pumping loss is large during middle and low loads of the engine in which the opening angle of the throttle valve is, particularly, small (narrow). Such a trial that a lift quantity or valve open and closure timings of the intake valve are varied so that the intake air quantity is controlled independently of the throttle valve has heretofore been made. Utilizing this technique, in the same way as a Diesel engine, such a structure of a, so-called, throttle-less intake air quantity control apparatus in which the throttle valve is not equipped in an intake system has been proposed.

A Japanese Patent Application First Publication No. 2001-263105 published on Sep. 26, 2001 discloses variably operated valve mechanisms which can continuously vary a valve lift, a working angle, and a central angle of the valve lift of the intake valve. According to such kinds of variably operated valve mechanisms as disclosed in the above-described Japanese Patent Application First Publication, it is possible to variably control the intake air quantity flowing into the cylinder independently of the opening angle control of the throttle valve. Particularly, in a small load region, a, so-called, throttle-less driving or the driving with the opening angle of the throttle valve sufficiently largely maintained can be achieved. Consequently, a remarkable reduction of the pumping loss can be achieved.

SUMMARY OF THE INVENTION

However, in the structure in which the two variably operated valve mechanisms are equipped and the working angle of the intake valve and its central angle thereof are mutually independently and variably controlled in accordance with an engine driving condition, during a transient state in which the engine driving state is abruptly varied, the two variably operated valve mechanisms are operated with respective delays to some degree with respect to each of their target values of the two variably operated valve mechanisms. Consequently, the intake air quantity is largely deviated from its target value. Especially, in a case where a relatively large difference in their mechanical delays is present (namely, one delay of the two variably operated valve mechanisms is relatively small but the other delay of the two variably operated valve mechanisms is relatively large), the intake air quantity is affected by the relatively large delay variably operated valve mechanism so that the intake air quantity is deviated from the target value. In addition, there is a possibility that a torque responsive characteristic especially during an acceleration becomes worsened.

It is, therefore, an object of the present invention to provide intake air control apparatus and method which are capable of enhancing a torque responsive characteristic, especially, during a transient state, namely, during an acceleration and are capable of effectively suppressing an influence of either relatively large mechanical delay variably operated valve mechanism of the first and second variably operated valve mechanisms.

According to one aspect of the present invention, there is provided an intake air control apparatus for an internal combustion engine, comprising: a first variably operated valve mechanism that enables a continuous variation of a working angle of an intake valve of the engine; a second variably operated valve mechanism that enables a continuous variation of a central angle of the working angle of the intake valve of the engine; a target angle calculating section that calculates a target angle of one of the first and second variably operated valve mechanisms from a target load in accordance with an accelerator opening angle and a present engine speed; a variably operated valve mechanism actual angle outputting section that derives an actual angle of the one of the first and second variably operated valve mechanisms which is varied toward the target angle of the one of the first and second variably operated valve mechanisms to output the derived actual angle as a corresponding variably operated valve mechanism actual angle equivalent value; and another target angle calculating section that calculates another target angle of the other of the first and second variably operated valve mechanisms from a present corresponding variably operated valve mechanism actual angle equivalent value, the present engine speed, and the target load on the basis of a known relationship among four of the working angle, the central angle, the engine speed, and a load achieved by the working angle, the central angle, and the engine speed.

According to another aspect of the present invention, there is provided an intake air control method for an internal combustion engine, comprising: providing a first variably operated valve mechanismthat enables a continuous variation of a working angle of an intake valve of the engine; providing a second variably operated valve mechanism that enables a continuous variation of a central angle of the working angle of the intake valve of the engine; calculating a target angle of one of the first and second variably operated valve mechanisms from a target load in accordance with an accelerator opening angle and a present engine speed; deriving and outputting an actual angle of the one of the first and second variably operated valve mechanisms which is varied toward the target angle of the one of the first and second variably operated valve mechanisms to output the derived actual angle as a corresponding variably operated valve mechanism actual angle equivalent value; and calculating another target angle of the other of the first and second variably operated valve mechanisms from a present corresponding variably operated valve mechanism actual angle equivalent value, the present engine speed, and the target load on the basis of a known relationship among four of the working angle, the central angle, the engine speed, and a load achieved by the working angle, the central angle, and the engine speed.

This summary of the invention does not necessarily describe all necessary features so that the invention may also be a sub-combination of these described features.

BRIEF DESCRIPTION OF THE DRAWINGS

FIG. 5 is a functional block diagram representing a detail of a second variably operated valve mechanism actual angle equivalent value calculating section shown in FIG. 4.

FIGS. 6A through 6D are integrally a timing chart representing a correction during an acceleration carried out in the intake air control apparatus shown in FIG. 1A.

DETAILED DESCRIPTION OF THE PREFERRED EMBODIMENTS

Reference will hereinafter be made to the drawings in order to facilitate a better understanding of the present invention.

Figure 1A:
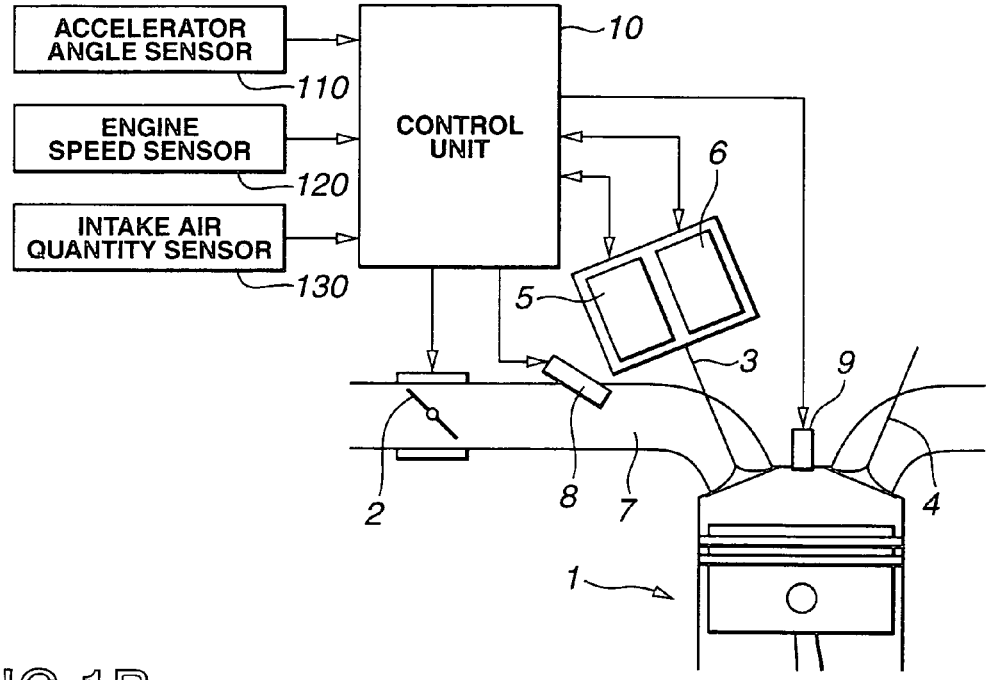
FIG. 1A is a structural explanatory view representing a system configuration of an intake air control apparatus in a first preferred embodiment according to the present invention.

FIG. 1A shows a system configuration explanatory view of an intake air control apparatus for an internal combustion engine. That is to say, an internal combustion engine 1 is provided with intake valves (or valves) 3 and exhaust valve (or valves) 4. As variably operated valve mechanisms of intake valve(s) 3, a first variably operated valve mechanism 5 (VEL which is an abbreviation for a variable valve event and lift mechanism) which is capable of expanding or contracting continuously a valve lift and a working angle of intake valve (or valves) 3 and a second variably operated valve mechanism 6 (VTC which is an abbreviation for a variable valve timing) which is capable of advancing or retarding a central angle of the working angle are provided. In addition, a negative pressure control valve 2 is installed within an intake air passage 7 and an opening angle of this valve 2 is controlled by means of an actuator such as a motor. It is, herein, noted that negative pressure control valve 2 is used to generate a slight negative pressure (for example, −50 mmHg) required for a process of blow-by gas and so forth within intake air passage 7. An adjustment of the intake air quantity is carried out by modifying the lift characteristic of intake valve(s) 3 by means of first and second variably operated valve mechanisms 5 and 6.

In more details, an opening angle of negative pressure control valve 2 (a target opening angle tBCV) is controlled so that an intake air negative pressure indicates constant (for example, 50 mmHg) in a predetermined low load region (first region). Then, in a high load region in which a demand load exceeds a maximum load which can be achieved by a modification of the lift characteristic while a development of the constant negative pressure, the lift characteristic is fixed to the lift characteristic at a point at which a limitation is given. Then, along with a further increase in an opening angle of an accelerator (accelerator opening angle) APO, the opening angle of negative pressure control valve 2 is further increased. In other words, an adjustment of the intake air quantity by modifying the lift characteristic of intake valve 3 while maintaining a relatively weak (small) intake air negative pressure up to a certain load is made. In a region of the high load region near to a negative pressure control valve full open region, the adjustment of the intake air quantity is carried out by reducing the intake air negative pressure.

A control of each of first and second variably operated valve mechanisms 5, 6 and negative pressure control valve 2 is carried out by means of a control unit 10. In addition, a fuel injection valve 8 is disposed within intake air passage 7. A fuel whose quantity is in accordance with the intake air quantity adjusted by means of intake valve(s) 3 or a negative pressure control valve 2 is injected through fuel injection valve 8. Hence, an output of internal combustion engine 1 is controlled by adjusting the intake air quantity through first and second variably operated valve mechanisms 5, 6 in the first region and by adjusting the intake air quantity through negative pressure control valve 2 in the second region.

Control unit 10 receives an accelerator opening angle signal APO from an accelerator opening angle sensor 110 installed on an accelerator pedal to be operated by a vehicle driver, an engine speed signal Ne from an engine speed sensor 120, and an intake air quantity signal from an intake air quantity sensor 130 and calculates a fuel injection quantity, an ignition timing, a first variable valve operated valve mechanism target angle (a target working angle), and a second variably operated valve mechanism target opening angle (a target central angle), respectively, on the basis of these received signals. Control unit 10 controls fuel injection valve 8 and a spark plug 9 to achieve a demanded fuel injection quantity and an ignition timing. Control signals to achieve first variably operated valve mechanism target angle and second variably operated valve mechanism target angle are outputted to an actuator of first variably operated valve mechanism 5 and an actuator of the second variably operated valve mechanism 6, respectively. It is herein noted that first variably operated valve mechanism 5 is driven by means of the actuator using an electric motor and second variably operated valve mechanism 6 is driven by means of a hydraulic type actuator with an engine lubricating oil pressure as a hydraulic pressure source. Then, a mechanical delay of first variably operated valve mechanism 5 when a target value is changed is relatively small and the mechanical delay of second variably operated valve mechanism 6 is relatively large.

Figure 1B:
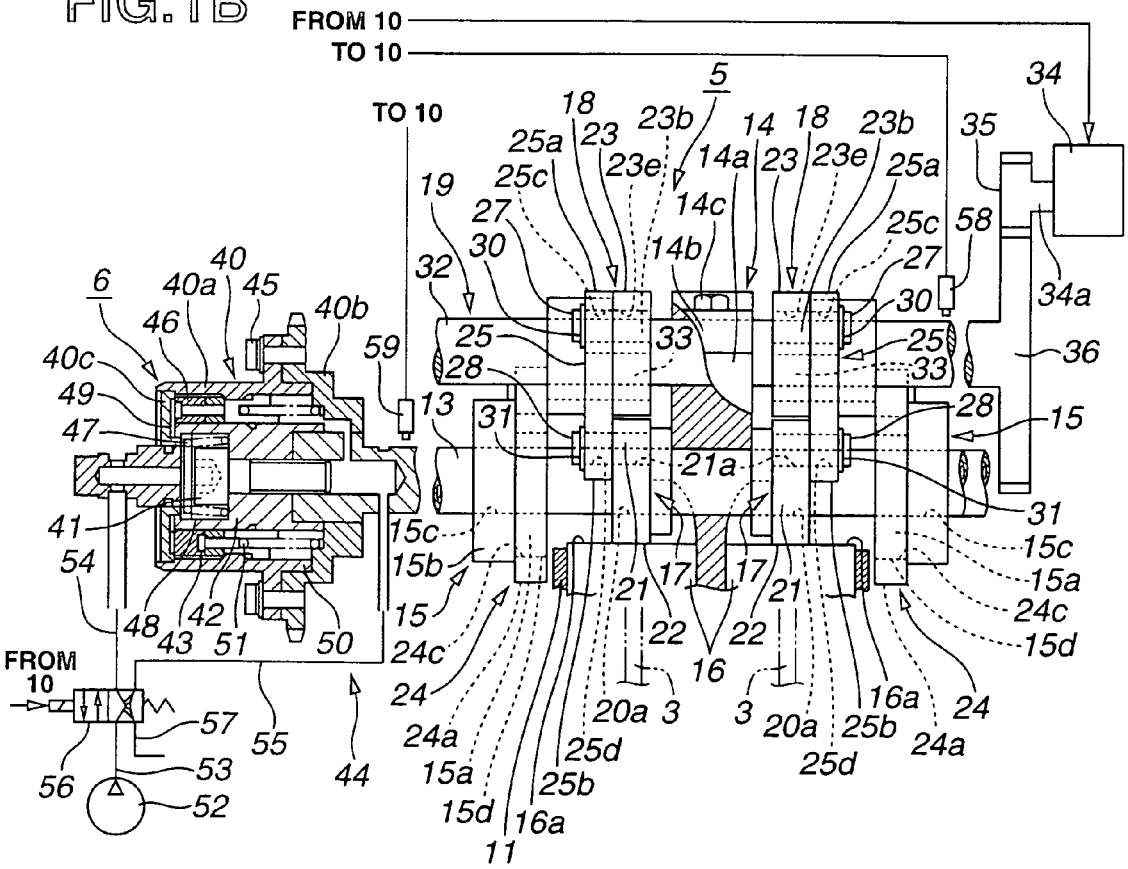
FIG. 1B is a structural explanatory view representing an example of first and second variably operated valve mechanisms shown in FIG. 1A.

FIG. 1B shows each of examples of the structures of first and second variably operated valve mechanisms 5 and 6. It is noted that the more detailed explanation of the structures of each of first and second variably operated valve mechanisms 5 and 6 are disclosed in the Japanese Patent First Publication No. 2001-263105 published on Sep. 26, 2001. In FIG. 1B, a reference numeral 11 denotes a cylinder head on which two intake valves 3, 3 (and two exhaust valves 4, 4 not shown in FIG. 1B) per cylinder are slidably installed via a valve guide (not shown). First variably operated valve mechanism 5 includes: a hollow drive axle 13 rotatably supported on a bearing 14 provided at an upper part of cylinder head 11; two drive cams 15, 15 which are eccentrically rotating cams fixed on drive axle 13 through a press fit; swing cams 17, 17 which are slidably contacted on flat upper surfaces 16*a*, 16*a* of valve lifters 16, 16 disposed on upper end surfaces of respective intake valves 3, 3; transmission mechanisms 18,18 interlinked between drive cam 15 and swing cams 17, 17 for transmitting a torque of drive cam as a swing force of swing cams 17, 17; and a control mechanism 19 which variably controls an operation position of each transmission mechanism 18, 18. Drive axle 13 is disposed along a cylinder row direction. The torque (a revolving force) of engine 1 is transmitted from an engine crankshaft to drive axle 13 via a timing chain (not shown) wound on a timing sprocket 40 of second variable valve mechanism 6 installed on one end of drive axle 13. In FIG. 1B, a reference numeral 14*a* denotes a main bracket of bearing 14, a reference numeral 14*b* denotes a sub bracket, and a reference numeral 14*c* denotes a pair of bolts. Both drive cams 15, 15 are ring shaped and includes cam main bodies 15*a*, 15*a* and relatively small-diameter cylindrical portions 15*b* installed integrally with cam main bodies 15*a*, 15*a*. In an internal axial direction, a drive axle penetrating hole 15*c* is formed. Outer peripheral surfaces 15*d*, 15*d* of cam main bodies 15*a*, 15*a* are formed on the same cam profile. On swing cams 17, a basic end portion, a supporting hole 20*a*, a cam nose portion 21, pin hole 21*a*, cam surfaces 22, 22, a basic circular surface, a ramp surface, and a lift surface are provided. On each valve lifter 16, upper surface 16*a* is provided. Transmission mechanism 18 includes a rocker arm 23 disposed on an upper side of drive axle 13; a ring-shaped link 24 which interlinks between one end portion of rocker arm 23 and drive cam 15; and a rod shaped link 25 which is an interlink member which interlinks between the other end portion 23*b* of rocker arm 23 and swing cam 17. on rocker arm 23, a pin hole 23*e* is formed through which a pin 27 relatively rotatable with one end 25*a* of each rod-shaped link 25. Ring-shaped link 24 includes a base portion 24*a* and a fitting hole 24*c*. Rod-shaped link 25 includes both end portions 25*a*, 25*b* and pin inserting holes 25*c*, 25*d*. A reference numeral 28 denotes pins and reference numerals 30 and 31 denote snap rings. A control mechanism 19 includes: a control axle 32 disposed in the forward-and-rearward direction of engine 1; control cams 33,33 fixed on an outer periphery of control axle 32; and an electric motor 34 which is an electrically driven actuator which controls the revolution position of control axle 32. Electric motor 34 includes: a first spur gear 35 installed on a tip of drive shaft 34*a* and meshed with a second spur gear 36 installed on a rear end portion of control axle 32 so that the torque is transmitted to control axle 32 and motor 34 is driven in response to the control signal from control unit 10. A reference numeral 58 denotes a first position detection sensor to detect a present revolution position of control axle 32 and outputs the detected revolution position of control axle 32 to control unit 10.

On the other hand, second variably operated valve mechanism 2 includes: timing sprocket 40 to which the torque (the revolving force) from the engine crankshaft is transmitted; a sleeve 42 fixed by means of a bolt 41 through the axial direction onto the tip of drive axle 13; a cylindrical gear 43 interposed between timing sprocket 40 and sleeve 42; and a hydraulic circuit 44 which is a drive mechanism which drives cylindrical gear 43 in the forward-and-rearward axial directions. Timing sprocket 40 has a sprocket portion 40*b* located on the rear end portion of cylinder main body 40*a* on which a chain is wound and fixed by means of a bolt 45 and a front end opening of cylindrical main body 40*a* is enclosed by means of a front cover 40*c*. A spiral bevel gear shaped outer gear 48 is formed on an outer peripheral surface of sleeve 42. Hydraulic circuit 44 includes: a main gallery 53 connected to a downstream side of an oil pump 52 communicated with an oil pan (not shown); first and second hydraulic pressure passages 54, 55 connected to first and second oil pressure chambers 49, 50; a flow passage switching valve 56 of a solenoid type installed on a branch side; and a drain passage 57 connected to flow passage switching valve 56. Flow passage switching valve 56 is switched and driven by means of the control signal from control unit 10 in the same way as the drivingly control of electric motor 34 of first variably operated valve mechanism 5. In FIG. 1B, a second position detection sensor 59 to detect a relative pivotal position between drive axle 13 and a timing sprocket 40 are provided. In FIG. 1B, a reference numeral 46 denotes an inner gear, a reference numeral 47 denotes a coil spring, and a reference numeral 51 denotes a return spring.

Figure 2:
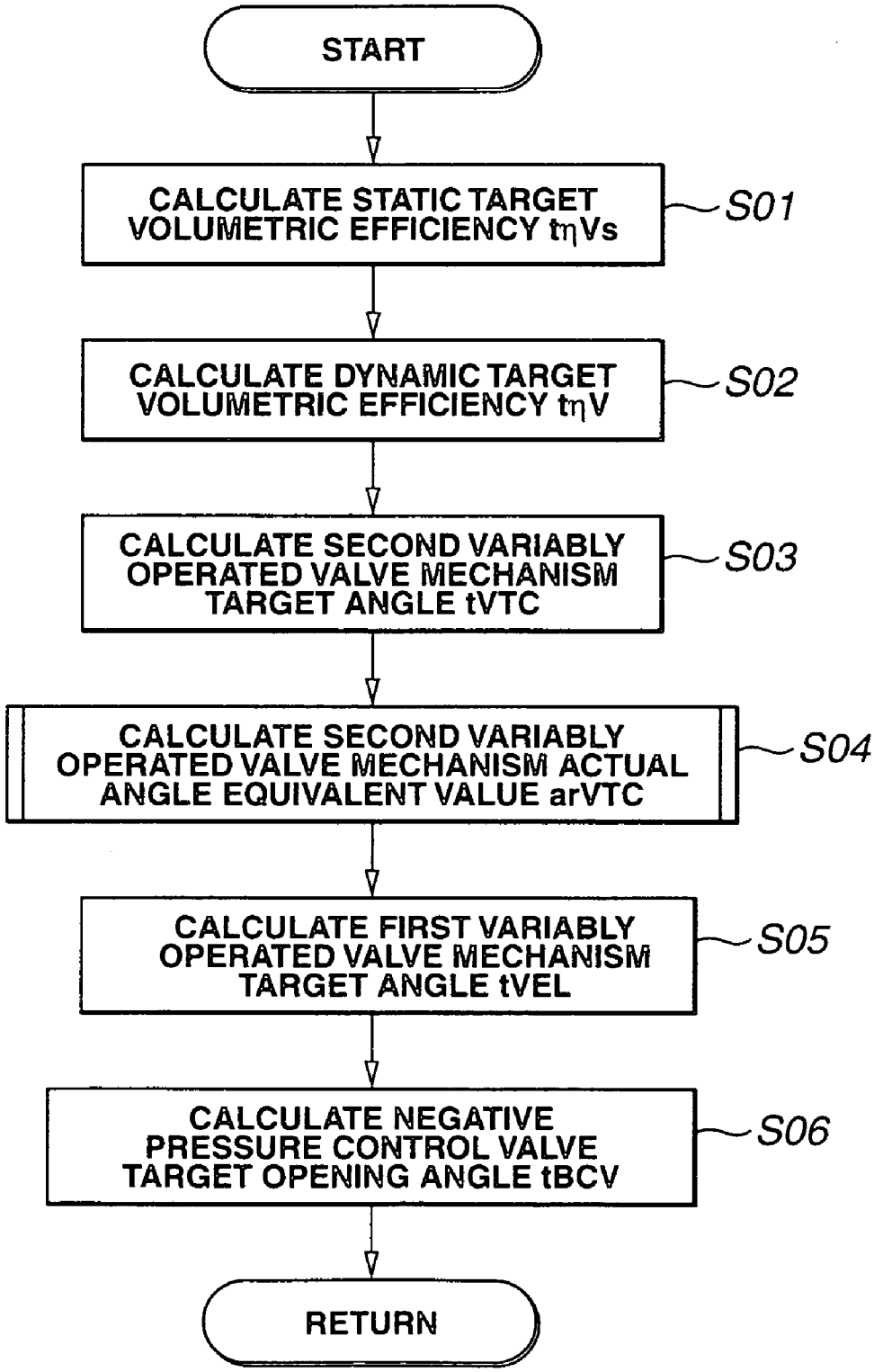
FIG. 2 is a flowchart representing an intake air control executed in the first embodiment of the intake air control apparatus shown in FIG. 1A.

FIG. 2 shows a flowchart representing a calculation process of calculating a first variably operated valve mechanism target angle tVEL, a second variably operated valve mechanism target angle tVTC, and a negative pressure control valve target angle tBCV in the first embodiment shown in FIG. 1A. In FIG. 2, a volumetric efficiency ηV is used as a load parameter representing a load. However, another parameter representing the load may be used. First, control unit 10 calculates a static target volumetric efficiency tηVs from accelerator opening angle APO and engine speed Ne (step S01). Control unit 10 calculates a dynamic target volumetric efficiency tηV by adding an appropriate correction as will be described later to this static target volumetric efficiency tηVs at a step S02. Next, control unit 10 calculates second variably operated valve mechanism target angle tVTC from this dynamic target volumetric efficiency tηV and engine speed Ne at a step S03. At a step S04, control unit 10 calculates second variably operated valve mechanism actual angle equivalent value arVTC with a response delay of second variably operated valve mechanism 6 with respect to target angle tVTC taken into consideration. At a step S05, control unit 10 calculates first variably operated valve mechanism target angle tVEL using this second variably operated valve mechanism actual angle equivalent value arVTC. At a step S06, control unit 10 calculates negative pressure control valve target angle tBCV from dynamic target volumetric efficiency tηV. In this embodiment, control unit 10 calculates second variably operated valve mechanism target angle tVTC and first variably operated valve mechanism target angle tVEL using dynamic target volumetric efficiency tηV not using static target volumetric efficiency tηVs.

Figure 3:
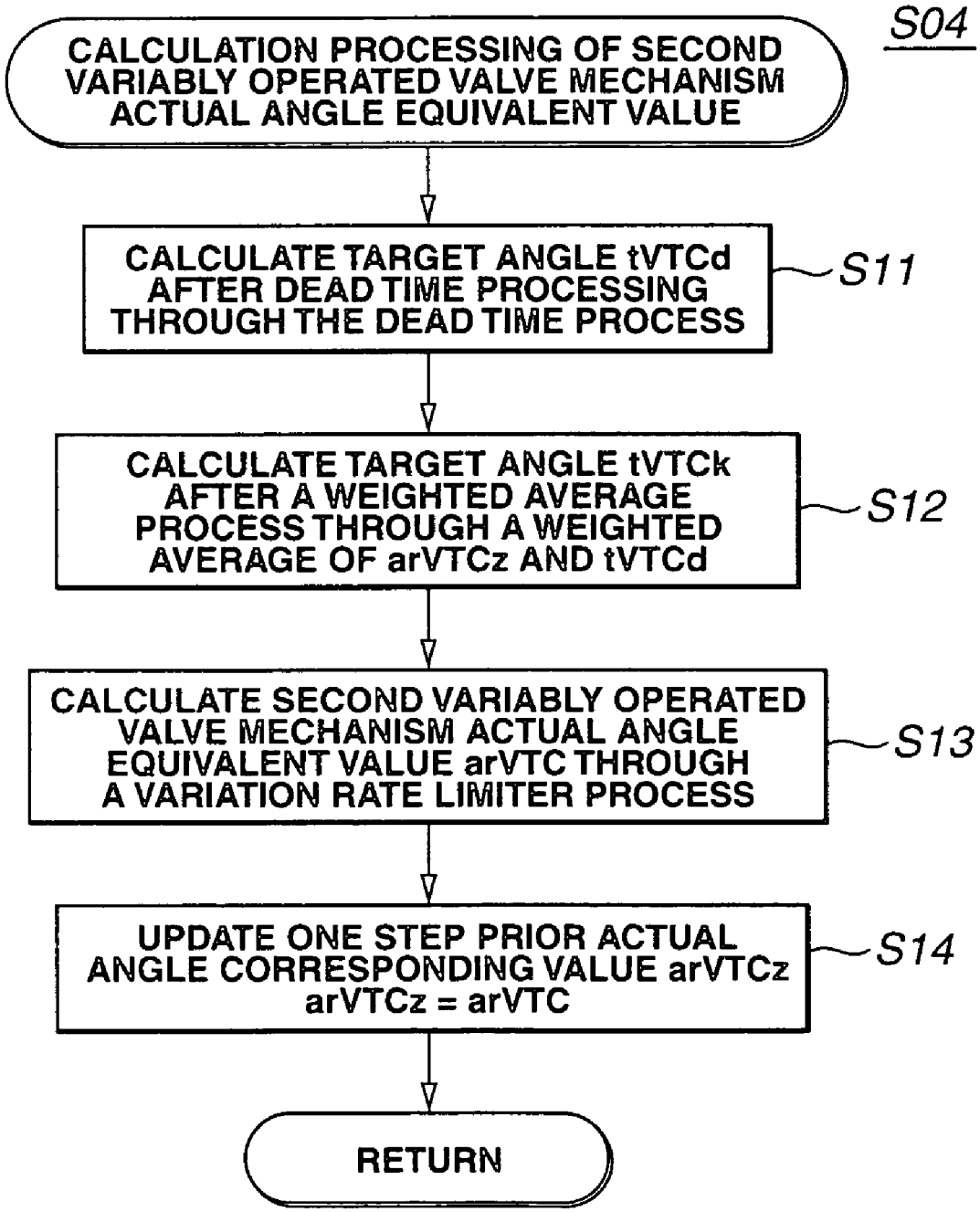
FIG. 3 is a detailed flowchart of a step S04 shown in FIG. 2.

FIG. 3 shows a flowchart representing a calculation processing of second variably operated valve mechanism actual angle equivalent value arVTC. That is to say, the details of step S04 described above are shown in FIG. 3. In this embodiment, actual angle equivalent value arVTC is estimated from second variably operated valve mechanism target angle tVTC without dependency on the sensor. This is basically an estimation of a value of an actual central angle which is gradually varied along a known responsive characteristic of second variably operated valve mechanism 6.

First, control unit 10 carries out a dead time processing corresponding to a dead time of the corresponding variably operated valve mechanism actuator to derive a post dead time processed target angle tVTCd (target angle after the dead time processing) at a step S11. Control unit 10 performs a weight averaging process for post dead time processed target angle tVTCd and one (control) step before target angle tVTCz to derive a weighted average (or called, weighted mean) process tVTCk at a step S12. At a step S13, control unit 10 makes a limitation of an abrupt variation by means of a variation rate limiter to calculate second variably operated valve mechanism actual angle equivalent value arVTC. At a step S14, control unit 10 finally updates one step prior (one control step before) actual angle equivalent value arVTCz used in the next weight averaging process (arVTCz=arVTC).

Figure 4:
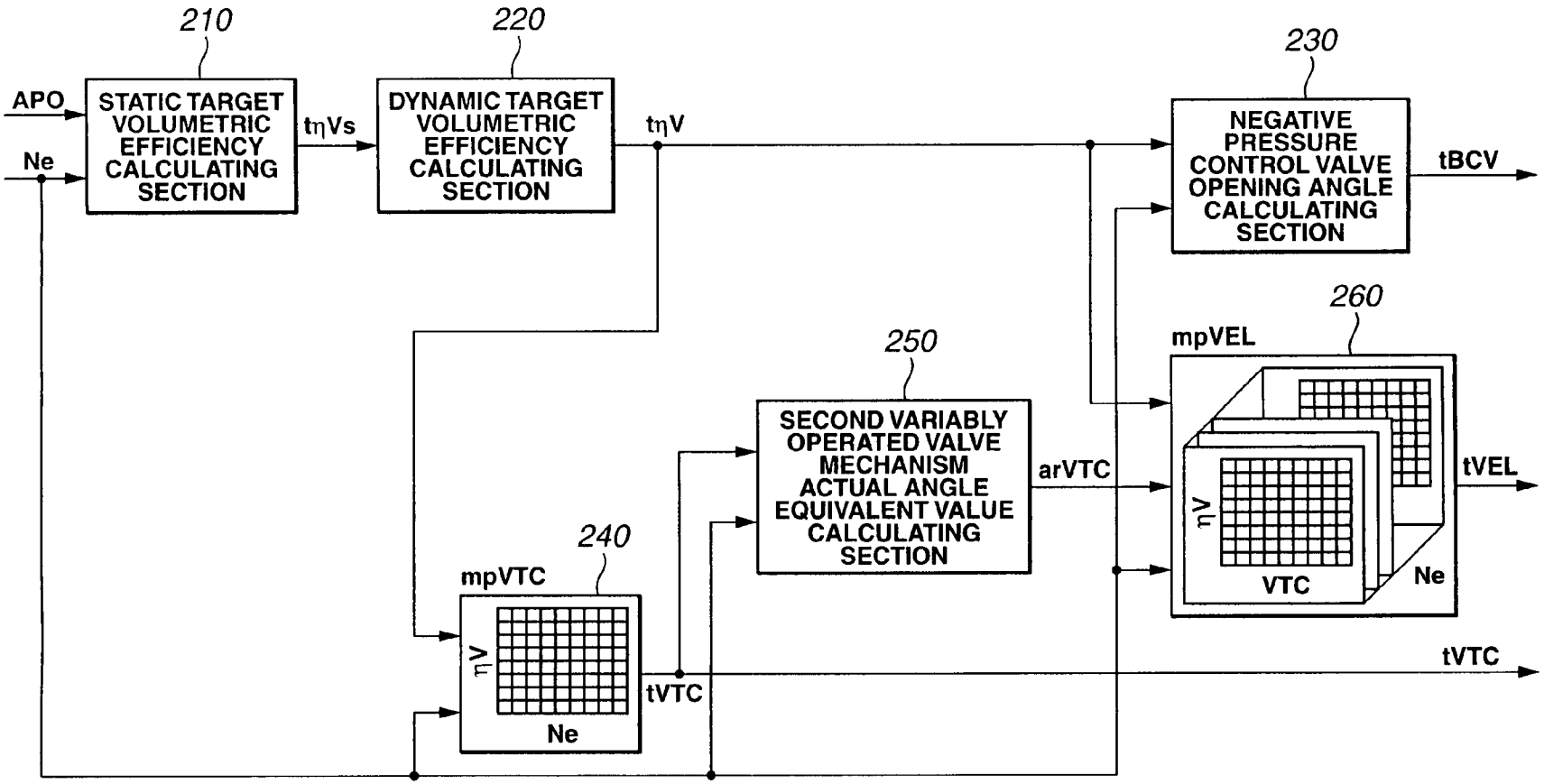
FIG. 4 is a functional block diagram representing the intake air control in the first preferred embodiment according to the present invention.

FIG. 4 shows a functional block diagram representing the contents of control used in the first preferred embodiment of the intake air control apparatus according to the present invention. In FIG. 4, APO denotes the accelerator opening angle and Ne denotes the engine speed. On the basis of these parameters, static target volumetric efficiency tηVs is calculated by static target volumetric efficiency calculating block 210. A dynamic target volumetric efficiency calculating section 220 calculates dynamic target volumetric efficiency tηV which is a correction for static target volumetric efficiency tηVs. On the basis of dynamic target volumetric efficiency tηV and engine speed Ne, negative pressure control valve target opening angle tBCV is calculated at a negative pressure control valve target opening angle calculating section 230. The opening angle of negative pressure control valve 2 is controlled in accordance with this target opening angle tBCV. Second variably operated valve mechanism target angle tVTC is searched from a second variably operated valve mechanism target angle calculation map mpVTC 240 on the basis of dynamic target volumetric efficiency tηV and engine speed Ne. Second variably operated valve mechanism 6 is controlled in accordance with target angle tVTC. Second variably operated valve mechanism actual angle equivalent value calculating section 250 calculates a second variably operated valve mechanism actual angle equivcalent value arVTC which corresponds to the actual central angle varying gradually. First variably operated valve mechanism target angle setting map mpVEL 260 is constituted by a multi-dimensional map in which a known relationship among four of a working angle VEL, a central angle VTC, engine speed Ne, and a load achieved by these parameters, namely, volumetric efficiency ηV is mapped. Then, by referring to first variably operated valve mechanism target angle setting map mpVEL 260, a value of first variable operated valve mechanism target angle tVEL corresponding to these three parameters is searched on the basis of dynamic target volumetric efficiency tηV, second variably operated valve mechanism actual angle equivalent value arVTC, and engine speed Ne.

It is noted that dynamic target volumetric efficiency calculating section 230 adds the correction such as a delay processing to static target volumetric efficiency tηVs such as to more accommodate to a feeling of a vehicle driver and can set a torque responsive characteristic to any arbitrary characteristic to a favorable characteristic. In addition, the working angle which gives a best fuel consumption while satisfying a combustion stability in a steady state is allocated to second variably operated valve mechanism target angle calculation map mpVTC 240 as target angle tVTC.

It is noted that, in the above-described embodiment, target angle tVTC searched from second variably operated valve target angle calculation map mpVTC 240 is a final second variably operated valve mechanism target angle tVTC. However, the present invention is not limited to this. A value in which a transient state correction is furthermore carried out for target angle tVTC searched from second variably operated valve operated valve mechanism target angle calculation map mpVTC 240 may be the final value of second variably operated valve mechanism target angle tVTC. In addition, although first variably operated valve mechanism target angle tVEL is directly searched from first variably operated valve mechanism target angle setting map mpVEL 260, first variably operated valve mechanism target angle tVEL may be calculated using a relationship among working angle VEL, central angle VTC, engine speed Ne, and volumetric efficiency ηV.

FIG. 5 shows a functional block diagram representing the details of second variably operated valve mechanism actual angle equivalent value calculating section 250 in the above-described embodiment. This functional block diagram corresponds to the flowchart shown in FIG. 3. As described above, post dead time processed target angle tVTCd is calculated at dead time processing section 310. A post weight average process target angle tVTCk at weight average process section 320 on the basis of the post dead time process target angle tVTCd, engine speed Ne, and one (control) step before actual angle equivalent value arVTCz. Then, second variably operated valve mechanism actual angle equivalent value arVTC is outputted via variation rate limiter process section 330 and is returned to weight average process section 320 as the next one (control) step prior actual angle equivalent value arVTCz. $z^{-1}$ denotes z transform operator indicating one control step delay.

Next, an action of the intake air control apparatus in the above-described first embodiment will be described on the basis of FIGS. 6A through 6D and FIG. 7. FIGS. 6A through 6D show integrally a timing chart representing an action of the above-described first embodiment when a transient state (for example, an acceleration) occurs. Supposing that the engine speed is maintained constant at a certain speed, FIGS. 6A through 6D show the action when a depression depth of an accelerator pedal (accelerator opening angle APO) is increased and a transient traveling of the vehicle is carried out. FIG. 6A shows a variation of target volumetric efficiency tηV. FIG. 6B shows the variation of first variably operated valve mechanism angle (working angle) VEL. FIG. 6C shows second variably operated mechanism angle (central angle) VTC. FIG. 6D shows the variation of an engine torque. It is noted that mechanical response characteristic of first variably operated valve mechanism 5 is very favorable (quick) as compared with the responsive characteristic of second variably operated valve mechanism 6 and is supposed to be negligible. If the depression depth (depression quantity) of accelerator opening angle is increased from a time point t1 to a time point t3, static target volumetric efficiency tηVs corresponding to accelerator opening angle APO is obtained as shown by a line of A1 in FIG. 6A and dynamic target volumetric efficiency tηV is obtained as shown by a line of A2 in FIG. 6A.

Suppose herein that the correction at the time of the transient state is not carried out. Then, supposing that first variably operated valve mechanism target angle and second variably operated valve mechanism target angle are calculated on the basis of a static target setting already set for each volumetric efficiency, the characteristics of first and second variably operated valve mechanisms 5, 6 are shown by a sign B1 in FIG. 6B and shown by a sign C1 shown in FIG. 6C. Then, the actual angle of second variably operated valve mechanism 6 having the mechanical delay provides a characteristic in a solid line shown by a sign C2 shown in FIG. 6C. Then, an actual torque response of engine 1 due to the response delay in central angle VTC of second variably operated valve mechanism 6 provides a line shown by a sign D1 shown in FIG. 6D. It is noted that an example in which the correction at the time of transient traveling is not carried out is called a comparative example.

Whereas, in the first embodiment, target angle tVEL of first variably operated valve mechanism 5 is calculated with actual angle equivalent value arVTC of second variably operated valve mechanism 6 which is varied along with the delay as a basis. That is to say, using the known relationship among four of working angle VEL, central angle VTC, engine speed Ne, and volumetric efficiency ηV achieved by these parameters, target angle tVEL of first variably operated valve mechanism 5 which can satisfy the demanded volumetric efficiency tηV as denoted by a line shown by a sign B2 of FIG. 6B is calculated from dynamic target volumetric efficiency tηV shown by sign A2 of FIG. 6A, actual angle equivalent value arVTC of second variably operated valve mechanism 6 shown by a sign C2 of FIG. 6C, and engine speed Ne. Consequently, as shown by a solid line shown by a sign D2 of FIG. 6D, the torque response equivalent to dynamic target volumetric efficiency tηV is obtained. The imp roved torque response characteristic than the torque response of the comparative example is seen.

Figure 7:
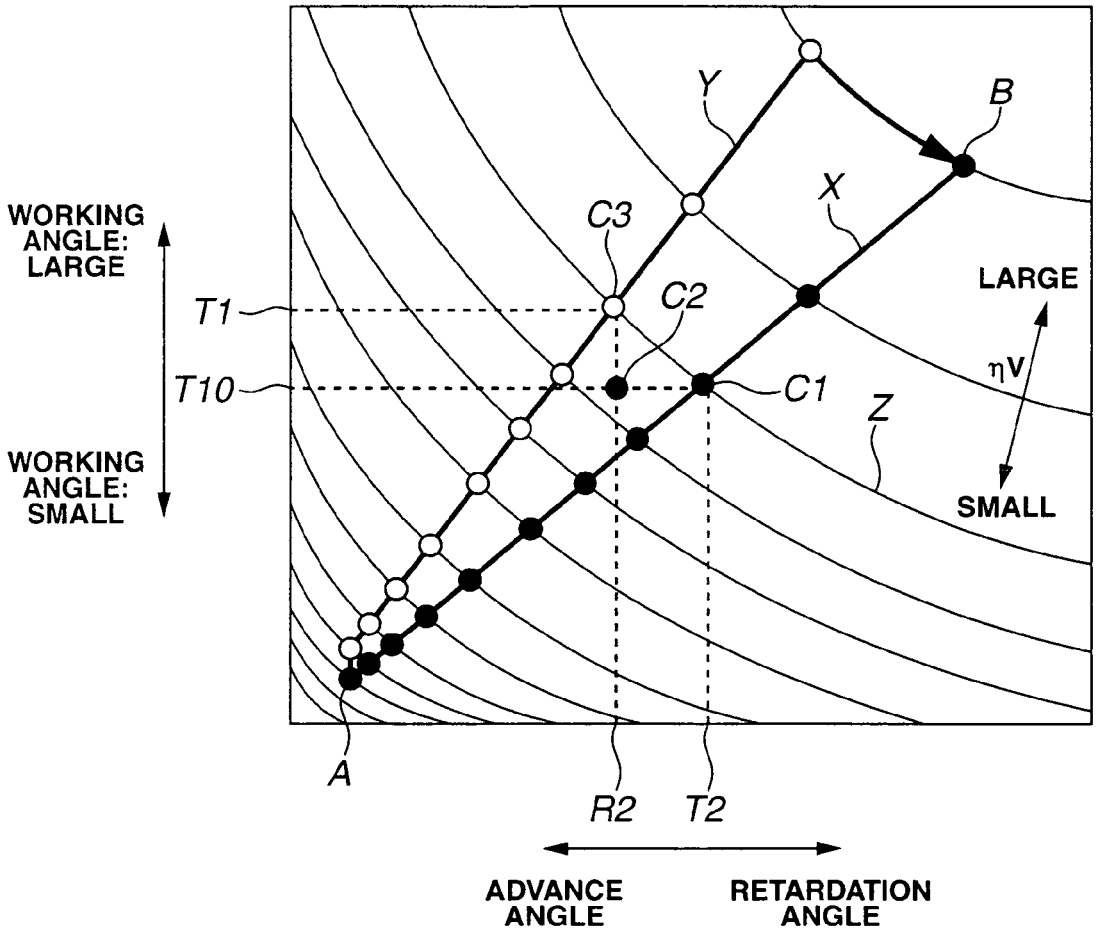
FIG. 7 is a graph representing a transition of a maximum lift point during the acceleration in the case of the first embodiment shown in FIG. 1A.

FIG. 7 shows a graph representing a transition (trajectory of variation) of a maximum lift point (in other words, the lift in the central angle of the intake valve when the transient traveling is carried out) of the intake valve and volumetric efficiency ηV when the transient traveling occurs. A lateral axis of FIG. 7 denotes central angle VTC and a longitudinal axis of FIG. 7 denotes working angle (in other words, lift) VEL and the maximum lift point is defined as the combination between these working angle and central angle. The maximum lift point is correlated to volumetric efficiency ηV. It is noted that volumetric efficiency ηV is denoted in a contour line form. In the range shown by FIG. 7, a right upper side of FIG. 7 is the high load side, i.e., volumetric efficiency ηV is large. In the acceleration run exemplified in FIG. 6, target volumetric efficiency ηV is increased from a point of low load side denoted by a sign A to a point of high load side denoted by a sign B.

In the comparative example, as a result of calculation of target angle tVEL of first variably operated valve mechanism 5 and target angle tVTC of second variably operated valve mechanism 6 on the basis of the static target setting denoted by black circle marks in FIG. 7, the maximum lift point by means of the target angle is obtained as denoted in line shown by a sign X shown in FIG. 7. It is herein noted that, with a time point of time t2 in FIGS. 6A through 6D taken into consideration, dynamic target volumetric efficiency tηV corresponds to a value shown by a sign A0 shown in FIG. 6A and corresponds to a value shown by a sign Z in FIG. 7. At this time, in the comparative example, target angle tVEL of first variably operated valve mechanism 5 and target angle tVTC of second variably operated valve mechanism 6 are denoted by signs T10 and T2, respectively, and the maximum lift point is a point denoted by a sign C1 shown in FIG. 7. However, in an actual practice, the response delay is involved in second variably operated valve mechanism 6. Hence, the actual angle of central angle VTC (this corresponds to second variably operated valve mechanism actual angle equivalent value arVTC) is a value denoted by a sign R2 in FIG. 7. Consequently, the maximum lift point is a point denoted by a sign C2 in FIG. 7. Hence, as appreciated from the relationship to volumetric efficiency ηV in the contour line form, volumetric efficiency ηV to be achieved becomes smaller than dynamic target volumetric efficiency tηV denoted by sign Z.

Whereas, in the first embodiment, by referring to first variably operated valve mechanism target angle setting map mpVEL 260 in which the relationship among working angle VEL, central angle VTC, engine speed Ne, and volumetric efficiency ηV achieved by these parameters is mapped, first variably operated valve mechanism target angle tVEL corresponding to second variably operated valve mechanism actual angle equivalent value arVTC is searched. Hence, first variably operated valve mechanism target angle tVEL is given as shown by a sign T1 so as to indicate maximum lift point (sign C3) under second variably operated valve mechanism actual angle equivalent value arVTC shown in sign R2 in FIG. 7. Consequently, a shift of the maximum point during the transient traveling of the vehicle is given by a sign Y shown in FIG. 7. In other words, first variably operated valve mechanism target angle tVEL is corrected in a direction such that working angle VEL becomes large as compared with a static target angle shown by line X in FIG. 7.

Figure 8:
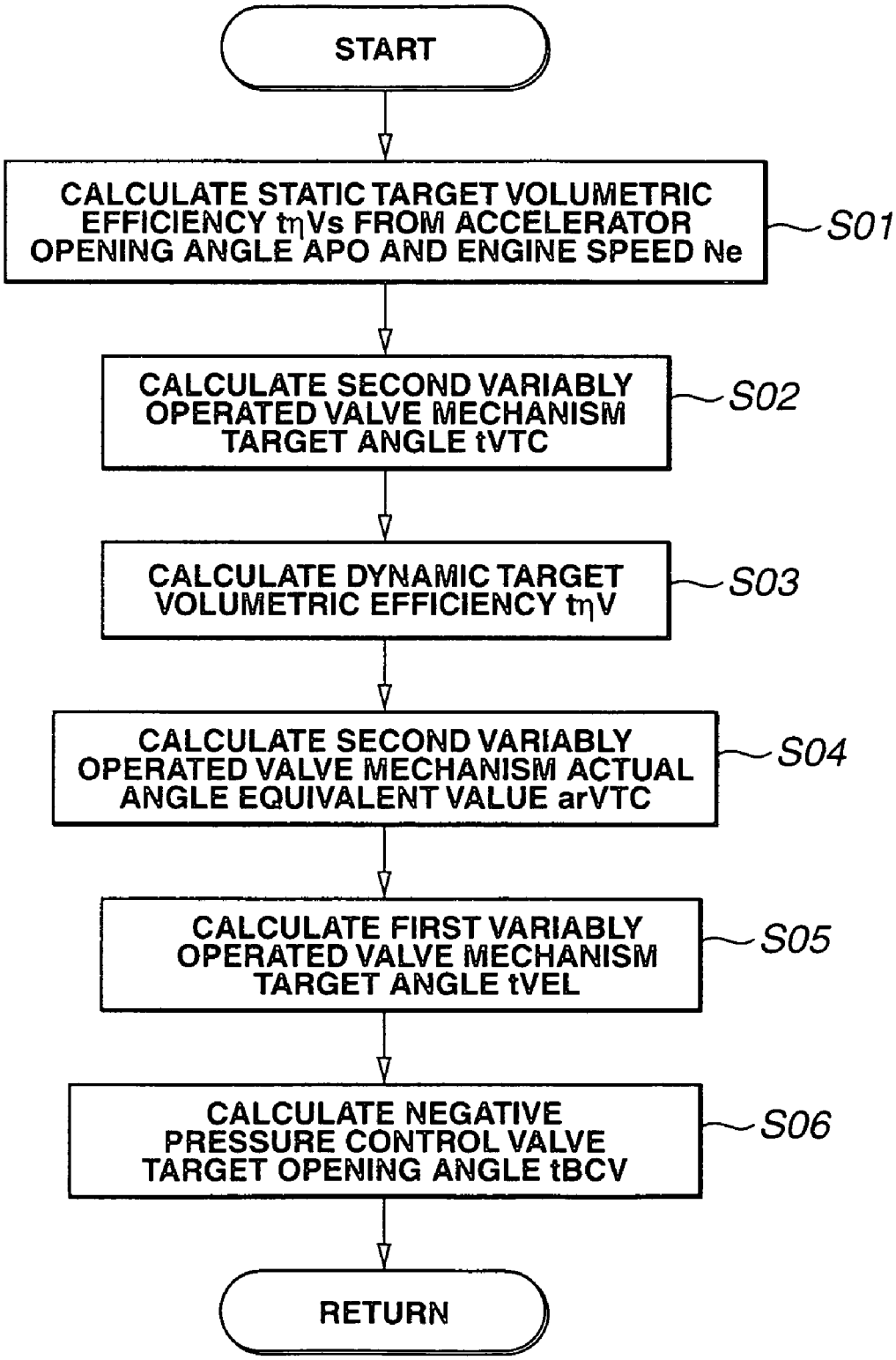
FIG. 8 is a flowchart representing the intake air control carried out in a second preferred embodiment according to the present invention.

Next, a second preferred embodiment of the intake air control apparatus according to the present invention will be described on the basis of FIGS. 8 through 11. FIG. 8 shows a flowchart of a processing to calculate first variably operated valve mechanism target angle tVEL, second variably operated valve mechanism target angle tVTC, and negative pressure valve target opening angle tBCV. It is noted that, in the second embodiment, as the load parameter representing the load, volumetric efficiency ηV is used in the same way as the first embodiment. However, the present invention is not limited to this. Another load parameter representing the load may be used. In the second embodiment, control unit 10 calculates second variably operated valve mechanism target angle tVTC from static target volumetric efficiency tηVs and first variable operated valve mechanism target angle tVEL from dynamic target volumetric efficiency tηV. At first, control unit 10 calculates static target volumetric efficiency tηVs from accelerator opening angle APO and engine speed Ne (at a step S01). Control unit 10, then, calculates second variably operated valve mechanism target angle tVTC from static target volumetric efficiency tηVs and engine speed Ne (at a step S02). Next, control unit 10 carries out an appropriate correction for static target volumetric efficiency tηVs to calculate dynamic target volumetric efficiency (at a step S03). In addition, control unit 10 calculates second variably operated valve mechanism actual angle equivalent value arVTC for second variably operated valve mechanism target angle tVTC in the same way as the first embodiment (at a step S04). Control unit 10 calculates first variably operated valve mechanism target angle tVEL using this second variably operated valve mechanism actual angle equivalent value arVTC (at a step S05). In the way described above, in the second embodiment, control unit 10 calculates second variably operated valve mechanism target angle tVTC using static target volumetric efficiency tηVs before the correction not using dynamic target volumetric efficiency tηV.

Figure 9:
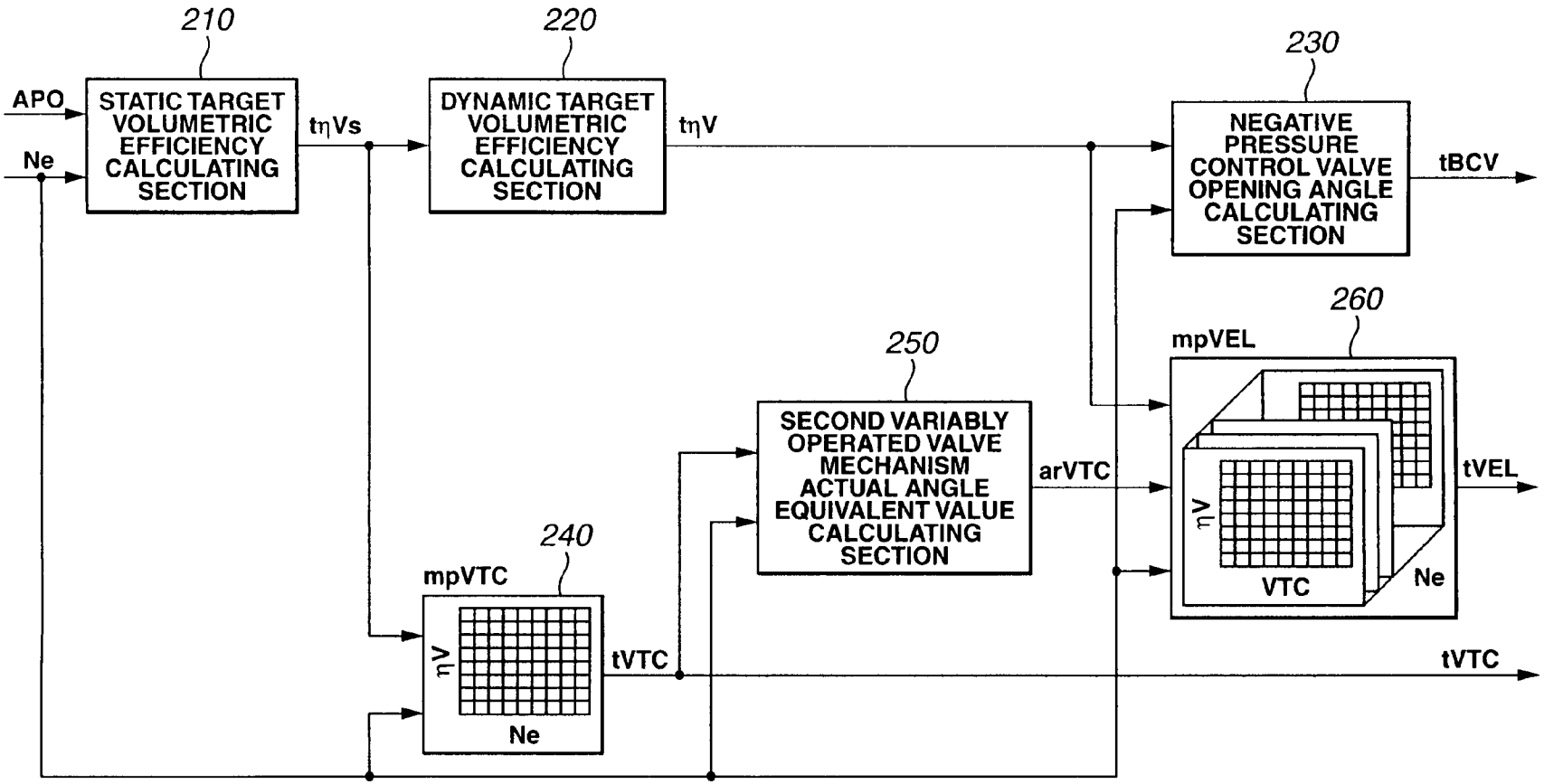
FIG. 9 is a functional block diagram representing the intake air control in the case of the second embodiment shown in FIG. 8.

FIG. 9 shows a functional block diagram of the contents of control in the second embodiment. In FIG. 9, static target volumetric efficiency calculating section 210 calculates static target volumetric efficiency tηVs on the basis of accelerator opening angle APO and engine speed Ne. Dynamic target volumetric efficiency calculating section 220 calculates dynamic target volumetric efficiency tηV which is a correction for static target volumetric efficiency tηVs. Negative pressure control valve target opening angle calculating section 230 calculates negative pressure control valve target opening angle tBCV on the basis of dynamic target volumetric efficiency tηV and engine speed Ne. On the other hand, control unit 10 searches second variably operated valve mechanism target angle tVTC from second variably operated valve mechanism target angle calculation map mpVTC 240 on the basis of static target volumetric efficiency tηVs before the correction and engine speed Ne. Second variably operated valve mechanism actual angle equivalent value calculating section 250 calculates second variably operated valve mechanism actual angle equivalent value arVTC which corresponds to the actual central angle which varies gradually. In the same way as the first embodiment, first variably operated valve mechanism target angle setting map mpVEL 260 is constituted by the multi-dimensional map in which the known relationship among four of working angle VEL, central angle VTC, engine speed Ne, and the load achieved by these parameters, namely, volumetric efficiency ηV are mapped. Control unit 10 searches a value of first variably operated valve mechanism target angle tVEL corresponding to these three parameters of dynamic target volumetric efficiency tηV, second variably operated valve mechanism actual angle equivalent value arVTC, and engine speed Ne by referring to first variably operated valve mechanism target angle setting map mpVEL 260.

As described above, dynamic target volumetric efficiency calculating section 220 carries out the correction such as the delay processing for static target volumetric efficiency tηVs to provide the characteristic, for example, accommodated to the feeling of the driver. It is possible to set the torque responsive characteristic during the transient state to an arbitrary characteristic to provide a preferable responsive characteristic. In addition, the working angle which provides a best fuel economy while satisfying the combustion stability in the steady state is allocated to second variably operated valve mechanism target angle calculation map mpVTC 240 as target angle tVTC.

Although, in this embodiment, target angle tVTC searched from second variably operated valve mechanism target angle calculation map mpVTC 240 is the final second variably operated valve mechanism target angle tVTC, a value thereof for which the transient correction is carried out may be the final second variably operated valve mechanism target angle tVTC. In addition, although, in this embodiment, first variably operated valve mechanism target angle tVEL is directly searched from first variably operated valve mechanism target angle setting map mpVEL 260, first variably operated valve mechanism target angle tVEL may be derived from its calculation using the known relationship among working angle VEL, central angle VTC, the engine speed Ne, and volumetric efficiency ηV.

An action of the second embodiment of the intake air control apparatus will be described on the basis of FIGS. 10A through 10D and FIG. 11.

Figures 10A, 10B, 10C, 10D:
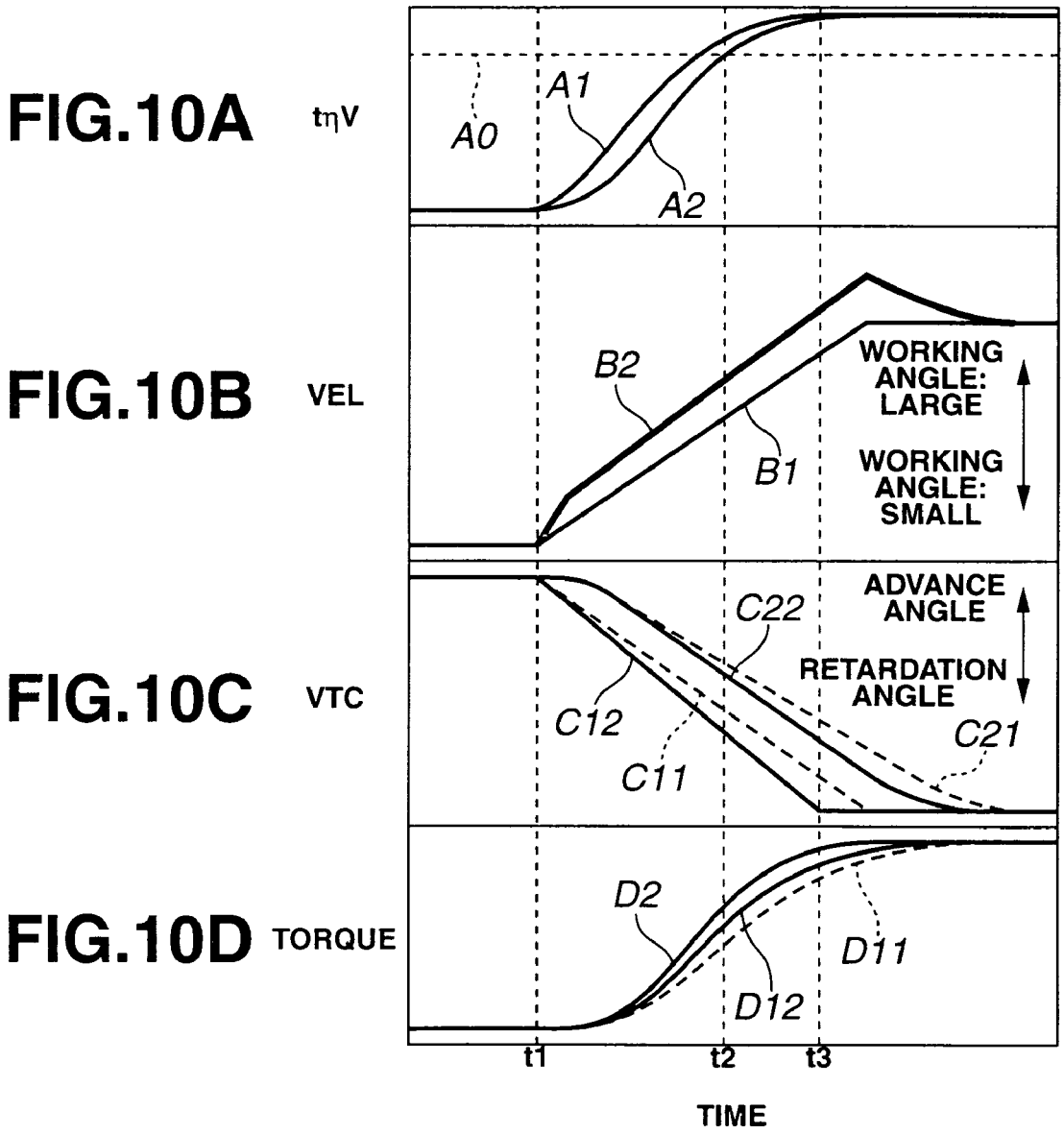
FIGS. 10A through 10D are integrally a timing chart representing the correction during the acceleration in the case of the second embodiment shown in FIG. 8.

FIGS. 10A through 10D show integrally a timing chart for explaining the operation of the second embodiment when the transient traveling (acceleration) is carried out. This is the action when the transient traveling is carried out such that the depression quantity of accelerator pedal (accelerator opening angle APO) is increased supposing that the engine speed is maintained constant at a certain revolution speed. FIG. 10A shows the variation of target volumetric efficiency tηV. FIG. 10B shows the variation of first variably operated valve mechanism angle (working angle) VEL. FIG. 10C shows the variation of second variably operated valve mechanism angle (central angle) VTC. FIG. 10D shows the variation of the engine torque. It is noted that a mechanical responsive characteristic of first variably operated valve mechanism 5 is very quick and is supposed to be negligible as compared with the responsive characteristic of second variably operated valve mechanism 6.

When the depression quantity of accelerator opening angle (APO) is increased from time t1 to time t3 during the traveling, static target volumetric efficiency tηVs corresponding to accelerator opening angle APO is obtained as a solid line denoted by a sign A1 of FIG. 10A and dynamic target volumetric efficiency tηV is obtained as a line denoted by a sign A2 in FIG. 10A.

Suppose herein that the correction during the transient state is not carried out and first variably operated valve mechanism target angle and second variably operated valve mechanism target angle are calculated on the basis of the static target settings preset for each volumetric efficiency. In this case, the characteristics are shown by lines denoted by a sign B1 in FIG. 10B and denoted by a sign C11 in FIG. 10C. Then, the actual angle of second variably operated valve mechanism 6 having, especially, the mechanical delay indicates the characteristic as shown by a line denoted by a sign C21 of FIG. 10C. Due to the influence of the response delay of central angle VTC of second variably operated valve mechanism 6, the torque response of actual engine 1 indicates the characteristic as shown by a line denoted by a sign D11 of FIG. 10D. It is noted that the example in which no correction during the transient state, hereinafter, is carried out is called, the comparative example to the second embodiment.

Whereas, in the second embodiment, second variably operated valve mechanism target angle tVTC is calculated from static target volumetric efficiency tηVs. Second variably operated valve mechanism target angle tVTC is obtained as shown by a line denoted by a sign C12 of FIG. 10C. Actual angle (or VTC) of second variably operated valve mechanism 6 is retarded than a case (C21) in which target angle tVTC is calculated from dynamic target volumetric efficiency tηV and indicates the characteristic as shown by a line denoted by a sign (C22) in FIG. 10C.

According to central angle VTC of the characteristic shown by sign C22 in FIG. 10C and working angle VEL of the characteristic shown by a sign B1 shown in FIG. 10B, the torque response characteristic is shown by a line denoted by a sign D12 of FIG. 10D. It is noted that this is called a second comparative example.

Then, in this embodiment, in the same way as the first embodiment, target angle tVEL of first variably operated valve mechanism 5 is calculated with actual angle equivalent value arVTC of second variably operated valve mechanism 6 which is varied along with the delay as a basis. In details, using the known relationship among working angle VEL, central angle VTC, engine speed Ne, and volumetric efficiency ηV achieved by these parameters, target angle tVEL of first variably operated valve mechanism 5 which can satisfy the demanded volumetric efficiency tηVs as shown by a line denoted by a sign B2 in FIG. 10B is calculated from dynamic target volumetric efficiency tηV shown in a line denoted by a sign A2 in FIG. 10A, actual angle equivalent value arVTC of second variably operated valve mechanism 6 shown in a line denoted by a sign C22 in FIG. 10C, and engine speed Ne. Consequently, as a line denoted by a sign D2 in FIG. 10D, the torque response equivalent to dynamic target volumetric efficiency tηV as shown in a line of a sign A2 in FIG. 10A is obtained. Thus, the torque response indicates an improved characteristic rather than the torque response of the comparative example.

Figure 11:
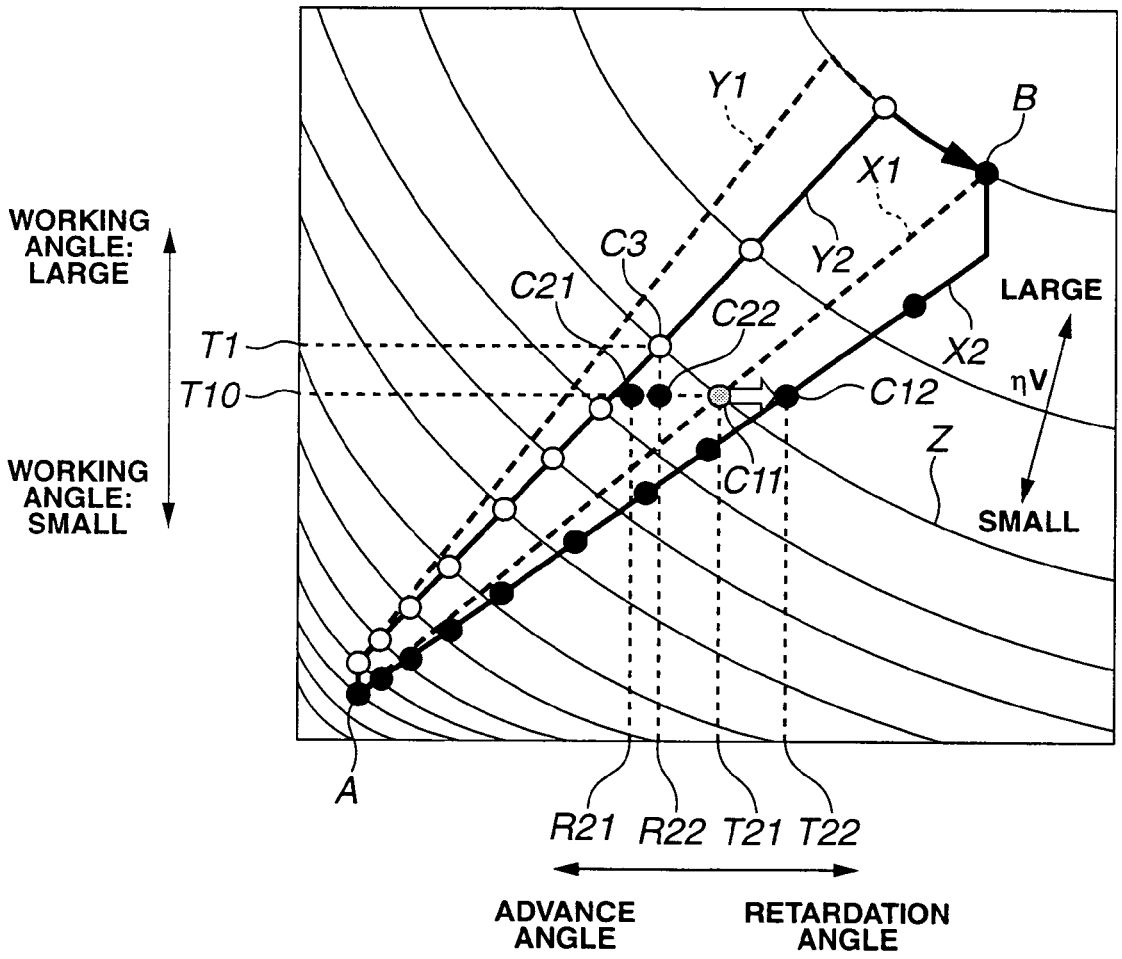
FIG. 11 is a graph representing a transition of the maximum lift point during the acceleration in the case of the second embodiment shown in FIG. 8.

FIG. 11 shows a graph representing the transition (a trajectory of the variation) of the maximum lift point of the intake valve(s) when the transient traveling of the vehicle in which the intake air control apparatus according to the second embodiment is mounted is carried out and volumetric efficiency ηV and is similar to FIG. 7. In the acceleration traveling shown by FIGS. 10A through 10D, target volumetric efficiency ηV is increased from a point on a low load shown by a sign A in FIG. 11 to a point on a high load shown by a sign B in FIG. 11. In the above-described comparative example, as the results of calculations of target angle tVEL of first variably operated valve mechanism 5 and of target angle tVTC of second variably operated valve mechanism 6 from the static setting, the maximum lift point by means of the target angle is obtained as shown by the line denoted by a sign X1 in FIG. 11. In addition, in a case where second variably operated valve mechanism target angle tVTC is calculated from static target volumetric efficiency tηVs as in the case of the second embodiment, second variably operated valve mechanism target angle tVTC is obtained at a retardation angle side than a case where second variably operated valve mechanism target angle tVTC is obtained from dynamic target volumetric efficiency tηV. Hence, the maximum lift point of target angle is obtained as shown by a line denoted by a sign X2 in FIG. 11. In addition, suppose a case at a time t2 in FIGS. 10A through 10D. Dynamic target volumetric efficiency tηV is a value shown by a sign A0 in FIG. 10A and corresponds to a line denoted by a sign Z in FIG. 11. At this time, in the comparative example, target angle tVEL of first variably operated valve mechanism 5 and target angle tVTC of second variably operated valve mechanism 6 indicate values shown by signs T10 and T21 shown in FIG. 11, respectively. Then, the maximum lift point is indicated by a sign C11 in FIG. 11. However, actually, second variably operated valve mechanism 6 involves a response delay. The actual angle (or estimated actual angle equivalent value) of central angle VTC is a value shown by a sign R21 in FIG. 11. Consequently, the maximum lift point indicates a point denoted by a sign C21 shown in FIG. 11. Hence, achievable volumetric efficiency ηV is smaller than dynamic target volumetric efficiency denoted by a sign Z shown in FIG. 11.

In the second comparative example in which second variably operated valve mechanism target angle tVTC is calculated from static target volumetric efficiency tηVs, target angle tVEL of first variably operated valve mechanism 5 and target angle tVTC of second variably operated valve mechanism 6 indicate values denoted by signs T10 and T22 shown in FIG. 11, respectively. The maximum lift point is indicated by a sign C12 shown in FIG. 11. However, actually, the actual angle of central angle VTC due to the response delay of second variably operated valve mechanism 6 indicates a value denoted by a sign R22 shown in FIG. 11. Achievable volumetric efficiency ηV becomes smaller than dynamic target volumetric efficiency shown by sign Z shown in FIG. 11.

On the other hand, in the second embodiment, by referring to first variably operated valve mechanism target angle setting map mpVEL 260 in which using the known relationship among four of working angle VEL, central angle VTC, engine speed Ne, and volumetric efficiency tηV achieved by these parameters, first variably operated valve mechanism target angle tVEL corresponding to second variably operated valve mechanism actual angle equivalent value arVTC is searched. Hence, first variably operated valve mechanism target angle tVEL is given as denoted by a sign T1 shown in FIG. 11 so as to provide a maximum lift point (sign C3) which satisfies dynamic target volumetric efficiency tηV shown by sign Z in FIG. 11 under second variably operated valve mechanism actual angle equivalent value arVTC shown by sign R22 in FIG. 11. Consequently, the transition of the maximum lift point during the transient traveling is as denoted by a sign Y2 in FIG. 11. In other words, first variably operated valve mechanism target angle tVEL is corrected in a direction in which working angle VEL becomes larger (wider) as compared with a static target angle shown by a line denoted by a sign X1 shown in FIG. 11.

In addition, as compared with the transition of the maximum lift point in the case of the first embodiment denoted by sign Y1 in FIG. 11, the correction quantity of first variably operated valve mechanism target angle tVEL from line X1 indicating the static target angle becomes small according to the second embodiment. As described hereinabove, on a presumption that the mechanical delay of second variably operated valve mechanism 6 is larger than that of first variably operated valve mechanism 5, the first and second embodiments in which second variably operated valve mechanism target angle tVTC is determined on the basis of the target load and first variably operated valve mechanism target angle tVEL is searched from the map on the basis of second variably operated valve mechanism actual angle equivalent value arVTC have been explained. On the contrary, in a case where the mechanical delay of first variably operated valve mechanism 5 is larger than second variably operated valve mechanism 6 according to the kinds of the actuators used, it is desirable that first variably operated valve target angle tVEL is determined on the basis of the target load and second variably operated valve mechanism target angle tVTC is calculated with the actual angle of working angle VEL which is gradually varied toward target angle tVEL as a basis.

Figure 12:
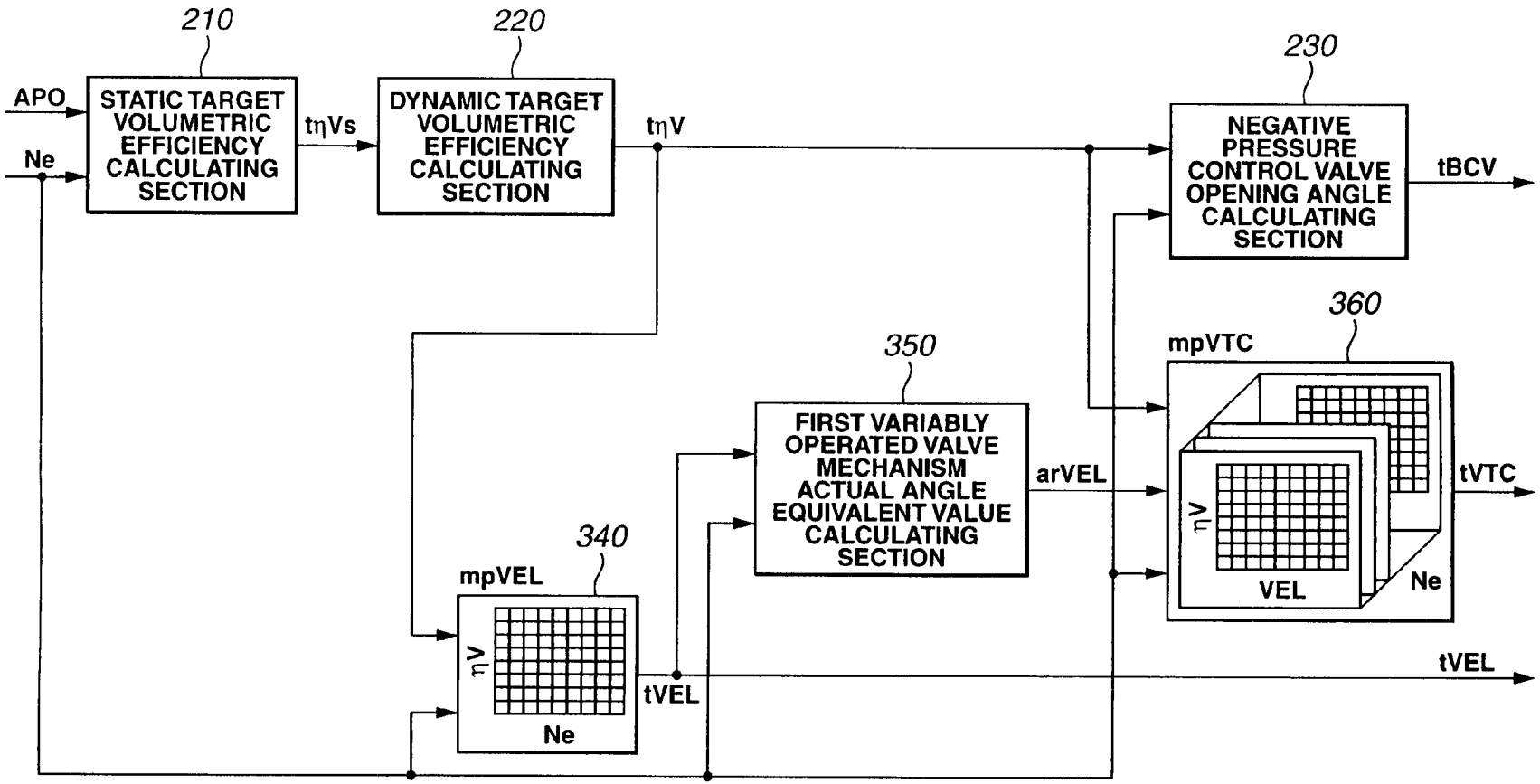
FIG. 12 is a functional block diagram of the intake air control apparatus in a third preferred embodiment according to the present invention.

FIG. 12 shows a functional block diagram representing a third preferred embodiment of the intake air control apparatus described above. As shown in FIG. 12, static target volumetric efficiency calculating section 210 calculates static target volumetric efficiency tηVs on the basis of accelerator opening angle APO and engine speed Ne. Dynamic target volumetric efficiency calculating section 220 calculates dynamic target volumetric efficiency tηV which is the correction of this static target volumetric efficiency tηV. Negative pressure control valve target opening angle calculating section 230 calculates negative pressure control valve target opening angle tBCV on the basis of dynamic target volumetric efficiency tηV and engine speed Ne. The opening angle of negative pressure control valve 2 is controlled in accordance with this target opening angle tBCV. The above-described functions are the same as described in the first embodiment. In the third embodiment, first variably operated valve mechanism target angle tVEL is searched from first variably operated valve target angle calculation map mpVEL 340 on the basis of dynamic target volumetric efficiency tηV and engine speed Ne. First variably operated valve mechanism 5 is controlled in accordance with target angle tVEL. First variably operated valve mechanism actual angle equivalent value calculating section 350 calculates first variably operated valve mechanism actual angle equivalent value arVEL which corresponds to gradually varying actual working angle on the basis of first variably operated valve mechanism target angle tVEL and engine speed Ne. Second variably operated valve mechanism target angle setting map mpVTC 360 is constituted by the multi-dimensional map in which the known relationship among working angle VEL, central angle VTC, engine speed Ne, and the load achieved by these parameters, namely, volumetric efficiency ηV. Then, the value of second variably operated variable valve mechanism target angle tVTC corresponding to these three parameters of dynamic target volumetric efficiency tηV, first variably operated valve mechanism actual angle equivalent value arVEL, and engine speed Ne is searched by referring to second variably operated valve mechanism target angle setting map mpVTC 360.

The entire contents of a Japanese Patent Application No. 2004-242066 (filed in Japan on Aug. 23, 2004) are herein incorporated by reference. The scope of the invention is defined with reference to the following claims.

What is claimed is:

1. An intake air control apparatus for an internal combustion engine, comprising:

a first variably operated valve mechanism that enables a continuous variation of a working angle of an intake valve of the engine;

a second variably operated valve mechanism that enables a continuous variation of a central angle of the working angle of the intake valve of the engine;

a target angle calculating section that calculates a target angle of one of the first and second variably operated valve mechanisms from a target load in accordance with an accelerator opening angle and a present engine speed;

a variably operated valve mechanism actual angle outputting section that derives an actual angle of the one of the first and second variably operated valve mechanisms which is varied toward the target angle of the one of the first and second variably operated valve mechanisms to output the derived actual angle as a corresponding variably operated valve mechanism actual angle equivalent value; and another target angle calculating section that calculates another target angle of the other of the first and second variably operated valve mechanisms from a present corresponding variably operated valve mechanism actual angle equivalent value, the present engine speed, and the target load on the basis of a known relationship among four of the working angle, the central angle, the engine speed, and a load achieved by the working angle, the central angle, and the engine speed.

2. An intake air control apparatus for an internal combustion engine as claimed in claim 1, wherein the target angle calculating section comprises a second variably operated valve mechanism target angle calculating section that calculates a target central angle of the second variably operated valve mechanism from the target load in accordance with the accelerator opening angle and the present engine speed, the variably operated valve mechanism actual angle outputting section comprises a second variably operated valve mechanism actual angle outputting section that derives and outputs an actual central angle of the second variably operated valve mechanism which is varied toward the target central angle as a second variably operated valve mechanism actual angle equivalent value, and the other target angle calculating section comprises a first variably operated valve mechanism target angle calculating section that calculates a target working angle of the first variably operated valve mechanism from a present second variably operated valve mechanism actual angle equivalent value, the present engine speed, and the target load on the basis of the known relationship of the four among the working angle, the central angle, the engine speed, and the load achieved by the working angle, the central angle, and the engine speed.

3. An intake air control apparatus for an internal combustion engine as claimed in claim 2, wherein the second variably operated valve mechanism actual angle outputting section drives and outputs a present central angle obtained by a sensor measuring an operating angle of the second variably operated valve mechanism actual angle equivalent value.

4. An intake air control apparatus for an internal combustion engine as claimed in claim 3, wherein the second variably operated valve mechanism actual angle outputting section determines whether a present engine driving state is a transient state or steady state from a difference between the target central angle and the present central angle obtained by the sensor measuring the operating angle of the second variably operated valve mechanism and outputs the target central angle directly as the second variably operated valve mechanism actual angle equivalent value in a case where the second variably operated valve mechanism actual angle outputting section determines that the present engine driving state is the steady state.

5. An intake air control apparatus for an internal combustion engine as claimed in claim 2, wherein the second variably operated valve mechanism actual angle outputting section derives and outputs a present central angle estimated from the target central angle of the second variably operated valve mechanism as the second variably operated valve mechanism actual angle equivalent value.

6. An intake air control apparatus for an internal combustion engine as claimed in claim 2, wherein the intake air control apparatus further comprises: a static target load calculating section that calculates a static target load from the accelerator opening angle and the engine speed; and a dynamic target load calculating section that corrects the static target load to derive a dynamic target load and wherein the second variably operated valve target angle calculating section calculates the target central angle using the static target load and the first variably operated valve target angle calculating section calculates the target working angle of the first variably operated valve mechanism using the dynamic target load.

7. An intake air control apparatus for an internal combustion engine as claimed in claim 6, wherein the static target load is a static target volumetric efficiency and the dynamic target load is a dynamic target volumetric efficiency.

8. An intake air control apparatus for an internal combustion engine as claimed in claim 1, wherein the known relationship of four of the working angle, the central angle, the engine speed, and the load achieved by the working angle, the central angle, and the engine speed is provided in a form of a multi-dimensional map.

9. An intake air control apparatus for an internal combustion engine as claimed in claim 1, wherein the first variably operated valve mechanism is driven by means of an electric power actuator and the second variably operated valve mechanism is driven by means of a hydraulic actuator.

10. An intake air control apparatus for an internal combustion engine as claimed in claim 2, wherein the intake air control apparatus further comprises: a static target volumetric efficiency calculating section that calculates a static target volumetric efficiency from the accelerator opening angle and the engine speed and a dynamic target efficiency calculating section that corrects the static target volumetric efficiency to derive a dynamic target volumetric efficiency from the accelerator opening angle and the engine speed and wherein the second variably operated valve mechanism target angle calculating section calculates the target central angle using the dynamic target volumetric efficiency for the target load and the first variably operated valve mechanism target angle calculating section calculates the first variably operated valve mechanism target angle using the dynamic target volumetric efficiency for the target load.

11. An intake air control apparatus for an internal combustion engine as claimed in claim 10, wherein the second variably operated valve mechanism actual angle equivalent value outputting section derives the second variably operated valve mechanism actual angle equivalent value with a responsive delay of the second variably operated valve mechanism to the target angle of the second variably operated valve mechanism taken into consideration.

12. An intake air control apparatus for an internal combustion engine as claimed in claim 10, wherein the first variably operated valve mechanism target angle calculating section searches target working angle from a multi-dimensional map representing the known relationship among the four of the working angle, the central angle, the engine speed, and the load achieved by the working angle, the central angle, and the engine speed on the basis of the dynamic target volumetric efficiency, the present second variably operated valve mechanism actual angle equivalent value, and the present engine speed.

13. An intake air control apparatus for an internal combustion engine as claimed in claim 12, wherein the intake air control apparatus further comprises a negative pressure control valve target angle calculating section that calculates a target opening angle of a negative pressure control valve installed within the intake air passage of the engine from the dynamic target volumetric efficiency and the engine speed.

14. An intake air control apparatus for an internal combustion engine as claimed in claim 10, wherein the second variably operated valve mechanism actual angle equivalent value outputting section comprises a post dead time processing section that performs a dead time processing for the target central angle of the second variably operated valve mechanism to derive a post dead time processed target central angle of the second variably operated valve mechanism; a weighted mean calculating section that calculates a weighted mean on the basis of the post dead time processed target central angle and one control step before second variably operated valve mechanism actual angle equivalent value; and a variation rate limiter that places a variation rate limitation on the weighted mean processed second variably operated valve mechanism actual angle equivalent value to drive and output the second variably operated valve mechanism actual angle equivalent value.

15. An intake air control apparatus for an internal combustion engine as claimed in claim 1, wherein the target angle calculating section comprises a first variably operated valve mechanism target angle calculating section that calculates a target working angle from the target load in accordance with the accelerator opening angle and the present engine speed, the variably operated valve mechanism actual angle outputting section comprises a first variably operated valve mechanism actual angle outputting section that derives and outputs an actual working angle of the first variably operated valve mechanism which is varied toward the target working angle as a first variably operated valve mechanism actual angle equivalent value, and the other target angle calculating section comprises a second variably operated valve mechanism target angle calculating section that calculates a target central angle of the second variably operated valve mechanism from a present first variably operated valve mechanism actual angle equivalent value, the present engine speed, and the target load on the basis of the four of the known relationship among the working angle, the central angle, the engine speed, and the load achieved by the working angle, the central angle, and the engine speed.

16. An intake air control apparatus for an internal combustion engine as claimed in claim 15, wherein the intake air control apparatus further comprises: a static target volumetric efficiency calculating section that calculates a static target volumetric efficiency from the accelerator opening angle and the engine speed; and a dynamic target volumetric efficiency calculating section that corrects the static target volumetric efficiency to derive a dynamic target volumetric efficiency and wherein the second variably operated valve target angle calculating section searches the target central angle from a multi-dimensional map representing the known relationship of the four of the working angle, the central angle, the engine speed, and a target load achieved by the working angle, the central angle, and the engine speed on the basis of the dynamic volumetric efficiency, the first variably operated valve mechanism actual angle equivalent value, and the engine speed.

17. An intake air control method for an internal combustion engine, comprising:

providing a first variably operated valve mechanism that enables a continuous variation of a working angle of an intake valve of the engine;

providing a second variably operated valve mechanism that enables a continuous variation of a central angle of the working angle of the intake valve of the engine;

calculating a target angle of one of the first and second variably operated valve mechanisms from a target load in accordance with an accelerator opening angle and a present engine speed;

deriving and outputting an actual angle of the one of the first and second variably operated valve mechanisms which is varied toward the target angle of the one of the first and second variably operated valve mechanisms to output the derived actual angle as a corresponding variably operated valve mechanism actual angle equivalent value; and calculating another target angle of the other of the first and second variably operated valve mechanisms from a present corresponding variably operated valve mechanism actual angle equivalent value, the present engine speed, and the target load on the basis of a known relationship among four of the working angle, the central angle, the engine speed, and a load achieved by the working angle, the central angle, and the engine speed.

18. An intake air control apparatus for an internal combustion engine, comprising:

first variably operated valve means for enabling a continuous variation of a working angle of an intake valve of the engine;

second variably operated valve means for enabling a continuous variation of a central angle of the working angle of the intake valve of the engine;

target angle calculating means for calculating a target angle of one of the first and second variably operated valve means from a target load in accordance with an accelerator opening angle and a present engine speed;

variably operated valve mechanism actual angle outputting means for deriving an actual angle of the one of the first and second variably operated valve means which is varied toward the target angle of the one of the first and second variably operated valve mechanisms to output the derived actual angle as a corresponding variably operated valve means actual angle equivalent value; and another target angle calculating means for calculating another target angle of the other of the first and second variably operated valve means from a present corresponding variably operated valve mechanism actual angle equivalent value, the present engine speed, and the target load on the basis of a known relationship among four of the working angle, the central angle, the engine speed, and a load achieved by the working angle, the central angle, and the engine speed.

* * * * *